US005988198A

United States Patent [19]

Neiman et al.

[11] Patent Number: 5,988,198

[45] Date of Patent: Nov. 23, 1999

[54] PROCESS FOR PUMPING BITUMEN FROTH THROUGH A PIPELINE

[75] Inventors: Owen Neiman; Ken Sury, both of Edmonton, Canada; Daniel D. Joseph; Runyuan Bai, both of Minneapolis, Minn.; Christopher Grant, Edmonton, Canada

[73] Assignees: AEC Oil Sands, L.P.; AEC Oil Sands Limited Partnership; Athabasca Oil Sands Investments Inc.; Canadian Occidental Petroleum Ltd.; Canadian Oil Sands Investments Inc.; Gulf Canada Resources Limited; Imperial Oil Resources, all of Calgary, Canada; Mocal Energy Limited, Tokyo, Japan; Murphy Oil Company Ltd.; Petro-Canada, both of Calgary, Japan

[21] Appl. No.: 09/190,019

[22] Filed: Nov. 12, 1998

[30] Foreign Application Priority Data

Nov. 12, 1997 [CA] Canada ..... 2220821

[51] Int. Cl.[6] ..... F17D 1/08

[52] U.S. Cl. ..... 137/13; 507/90

[58] Field of Search ..... 137/13; 507/90

[56] References Cited

U.S. PATENT DOCUMENTS

| | | | |
|---|---|---|---|
| 2,821,205 | 1/1958 | Chilton et al. . | |
| 3,225,787 | 12/1965 | Gogarty et al. . | |
| 3,502,103 | 3/1970 | Verschuur . | |
| 3,791,395 | 2/1974 | Dunlap et al. . | |
| 3,822,721 | 7/1974 | Verschuur . | |
| 3,826,279 | 7/1974 | Verschuur . | |
| 3,886,972 | 6/1975 | Scott et al. . | |
| 3,892,252 | 7/1975 | Poettmann . | |
| 3,977,469 | 8/1976 | Broussard et al. . | |
| 4,047,539 | 9/1977 | Kruka | 137/13 |
| 4,745,937 | 5/1988 | Zagustin et al. . | |

FOREIGN PATENT DOCUMENTS

| | | |
|---|---|---|
| 1008108 | 4/1977 | Canada . |

*Primary Examiner*—Gerald A. Michalsky

*Attorney, Agent, or Firm*—Millen, White, Zelano & Branigan, P.C.

[57] ABSTRACT

A process for transporting deaerated bitumen froth in a pipeline is described which comprises injecting water into the pipeline prior to deaerated bitumen froth injection to wet the interior walls of the pipeline. The deaerated bitumen froth is then injected into the pipeline at a critical velocity above 0.3 m/sec thereby initiating self-lubricating core-annular flow of the bitumen froth.

12 Claims, 7 Drawing Sheets

PROCESS FOR PUMPING BITUMEN FROTH THROUGH A PIPELINE

FIELD OF THE INVENTION

The present invention relates to a process for pumping deaerated bitumen froth under conditions of core-annular flow through a pipeline for a considerable distance.

BACKGROUND OF THE INVENTION

A recent development in the recovery of upgraded oil products from surface-mined oil sands located in the Fort McMurray region involves the formation of a low-temperature, deaerated bitumen froth at locations that may be far removed from the upgrading facilities. Hence, the bitumen froth may need to be pumped through a pipeline over long distances (in order of 35 km) so that the froth can be further upgraded at the existing upgrading facilities.

The bitumen froth that is produced from oil sands routinely contains about 20–40% by volume dispersed water in which colloidal clay particles are well dispersed. Such an oil-water mixture is very stable and very viscous, having viscosities even higher than the oil alone.

It can be very costly from an energy standpoint to transport a viscous material such as bitumen froth through a pipeline. Significant pressure drops can occur along the pipeline due to the shear stresses between the pipe wall and the viscous fluid. Also, the oily, viscous fluid being transported may cause "fouling" of the pipeline to occur. Fouling of the pipeline is a result of oil sticking to the generally oleophilic pipe walls, particularly at sites of sharp changes in flow direction, thereby resulting in a continual increase in the pressure gradient required to drive the flow. The fouling may ultimately result in the total blockage of the pipeline.

A known procedure for reducing some of the aforementioned problems encountered in transporting viscous oils through a pipeline involves the introduction of a less viscous immiscible fluid such as water into the flow of oil, to act as a lubricating layer between the pipe wall and the oil. This procedure for transporting viscous oil is commonly referred to as core-annular flow.

The conventional means for establishing core-annular flow is to inject water and oil simultaneously, with the water collecting in the annulus and encapsulating the oil core.

The design of injection nozzles and control of the flow rates impacts on the formation of a lubricated layer and on the time and downstream distance necessary to establish lubricated flow. Establishing lubricated flow in conventional applications is a manageable problem that can usually be controlled by varying the rate of water and oil injection. In fact, different flow types with different pressure gradients can be achieved by varying the injection rates (see, for example, Joseph, D. D. & Renardy, Y. Y., (1992), Fundamentals of Two-Fluid Dynamics, Part II: Lubricated Transport, Drops and Miscible Liquids. (Springer, N.Y.)).

Conventional methods for establishing core-annular flow are impractical for the start-up of core flow of bitumen froth, as the addition of water is undesirable. As previously stated, the froth already contains 20–40% water by volume in its natural state and therefore, the addition of more water makes the separation of bitumen from water in subsequent processing more difficult. In addition, adding more water will decompose the froth. Hence, it was necessary to develop a process where core-annular flow could be achieved in the pipeline without requiring the addition of more water to the froth. This invention is directed towards a process that allows the bitumen froth to be self-lubricating. In other words, it is the water already present in the bitumen froth that forms the lubricating outer layer surrounding the oily core.

A method for starting self-lubricated flow of water in oil emulsions (5 to 60% water by weight) was described in the U.S. Pat. No. 4,047,539 to Kruka. This patent teaches the start-up of self-lubricated flow of emulsions of water in Midway-Sunset crude oils by creating a certain shear rate for a certain length of time in a pipe flow to break the emulsion and create a water rich zone near the pipe wall. When the water in oil emulsions are subjected to faster shearing, water droplets are produced and these water droplets will tend to coalesce and form a self-lubricating layer of free froth water. The shear rates required to break up the emulsion were achieved by slow increases in pressure. However, the method of slow increases in pressure will not work in long commercial pipelines because the pressure drop required. to produce the critical shear rates is too large. Hence, the Kruka process can not be used for the transport of bitumen froth through 35 km of pipeline.

A process for restarting core flow of viscous oils after a long standstill period was described in U.S. Pat. No. 4,753,261 to Zagustin et al. The process involved the controlled injection of water. However, this process still requires the injection of more water than is desirable when attempting to start the self-lubricated flow of bitumen froth.

SUMMARY OF THE INVENTION

The present application describes a procedure for the start-up of self-lubrication of bitumen froth in which the bitumen froth is injected into a pipeline, behind moving water, at a speed faster than that required to break up the water-oil emulsion (in the order of 0.3 m/sec) thereby achieving core-annular flow of the bitumen.

In one broad aspect, the invention provides a process for transporting deaerated bitumen froth containing 20 to 40% by volume froth water, said froth water containing colloidal-size particles with amphilic properties (ie. particles that are hydrophilic but readily stick to the crude oil), through a pipeline, thereby establishing self-lubricated core-annular flow of the deaerated bitumen froth, comprising:

injecting water into the pipeline to make the interior walls of the pipeline water-wet; and injecting deaerated bitumen froth into the pipeline behind the water at a velocity greater than 0.3 m/sec.

The bitumen froth routinely contains between 20 to 40% froth water. The froth water is milky due to the dispersion of small day particles (in the order of 0.5 wt %) in the water. These clay particles are amphilic of colloidal size and are held in suspension by Brownian motions.

It is believed that the establishment of core-annular flow of bitumen froth without the need for water addition is due, in part, to the unusual properties of bitumen froth. It has been observed that bitumen froth is unstable to faster shearing which causes the froth water droplets to coalesce and form a lubrication layer of free froth water. In fact, tests indicate that even under static conditions there is a tendency for droplets of froth water to coalesce. This unusual property is believed to be due to the dispersion of the colloidal particles in the froth water.

The clay in the froth water inhibits the coalescence of bitumen and may promote the coalescence of the clay water droplets through a mechanism that can be called "powdering the dough". Dough is sticky, but when it is covered with flour powder it losses its stickiness and is protected against sticking by the layer of powder. The clay in froth water acts like powder; it sticks to the bitumen thereby preventing the bitumen from coalescing. This allows the water droplets to coalesce into water sheets and these sheets will lubricate the flow of the bitumen.

The free water that is generated at the wall in a pipe flow is opaque. One cannot see through it except at points where "tiger waves" occur. This type of wave formation is a common phenomenon seen in core-annular flows. The free milky water layer that forms on the inner walls of the pipeline i roughly 20 to 30% by weight of the original water in the bitumen froth. This indicates that considerable coalescence has occurred.

It has also been shown that core-annular flow of bitumen froth in a pipeline can be achieved when the froth is pumped at or above the critical velocity of 0.3 m/sec into a water-wet pipeline behind air rather than water.

It was observed that the critical velocity for establishing self-lubrication decreases as the temperature of the bitumen froth increases. Therefore a preferred embodiment of the process would be heating the bitumen froth up to about 60° C. prior to injecting it into the pipeline.

If the pipeline already has bitumen sticking to walls of the pipe, it is desirable to pre-treat the pipeline with water containing colloidal particles. The colloidal particles will "powder" the stuck bitumen thereby preventing further build-up of bitumen when bitumen froth is introduced into the pipeline. Therefore, in a preferred embodiment, the water used to make the pipe walls water wet also contains colloidal particles of amphilic type.

Another aspect of the invention includes a novel procedure for starting up a pipeline of considerable length that is filled with deaerated froth after pumping has been temporarily shut down. A very high pressure would be needed to get the entire froth load moving and replace it with water. It is therefore suggested that the length of pipeline be divided into a series of sequential segments of substantially equal length. Each segment would be connected with a water source and a pump. The segment of froth would then be replaced with water at above-critical velocity at relatively low pumping pressure. Once all of the froth in the segments had been sequentially replaced with water, then displacement of the water with froth would be initiated at a pumping rate conducive to causing core-annular flow.

Another aspect of the invention is the observation that the coating of bitumen with colloidal particles also results in long-term durability against fouling because the coated bitumen will not stick to itself or to the pipeline walls. Therefore, the fouling of pipe walls by heavy oils experienced during conventional startups of core-annular flow in pipelines may be prevented by adding amphilic solids of colloidal size to the water used to initiate core-annular flow in a concentration above that necessary for saturation of the oil-water interface. The particles must be both hydrophilic and oleophilic so that a water layer will be retained between protected heavy oil in touching contact.

DESCRIPTION OF THE PREFERRED EMBODIMENT

As previously mentioned the start-up procedure for establishing self-lubrication of bitumen froth involves the introduction of froth, behind a water flow, at speeds greater than critical. Lubrication is established almost immediately by this method. The water that is first introduced into the pipeline is subsequently diverted from the pipeline to allow continuous self-lubricated froth flow. It is important to introduce the froth at a velocity high enough to promote coalescence of the clay water droplets into a film of lubricating water. Velocities in the order of 1 m/sec have been repeatedly used to successfully achieve self-lubricating core-annular flow of bitumen froth in 1", 2" and 24" pipes (although somewhat lower speeds may also work).

Figure 1:
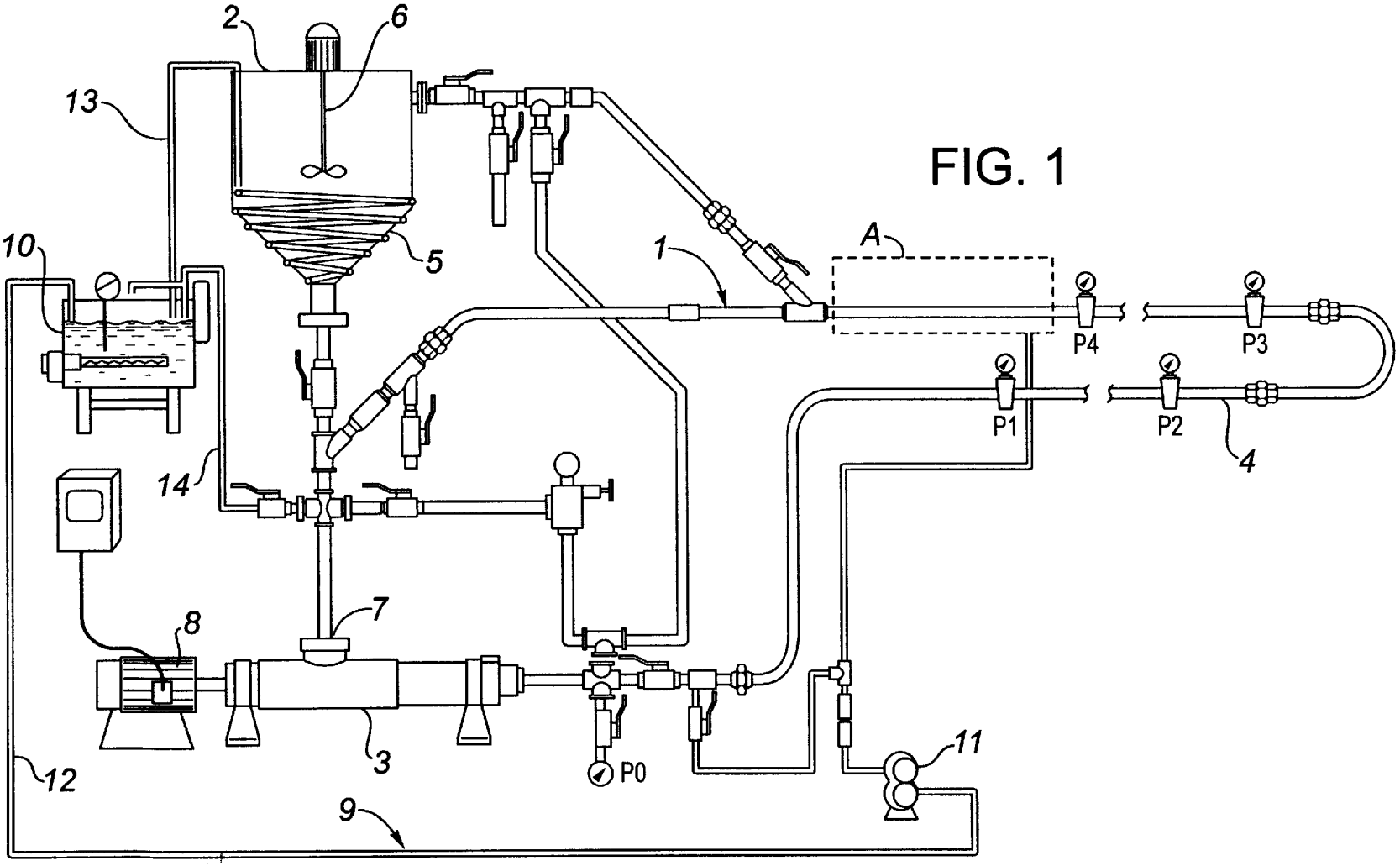
FIG. 1 is a schematic of the 1" diameter, 6 m long pipeline test facility used to test self-lubrication conditions.

FIG. 1 is a schematic showing the 1 " (25 mm) diameter, 6 m long pipeline test facility used to test self-lubrication conditions. There am two major loops that are interconnected in this facility. The main loop 1 is where the bitumen froth circulates and comprises a supply tank 2, a three stage Moyno pump 3, and a 1" (25 mm) diameter, 6 m long pipeline 4. Throughout the course of the pipeline loop, there are situated several taps 20 for sampling. The supply tank 2 is made of cast steel with a conical bottom 5, which promotes the flow of froth to the Moyno pump 3. The supply tank 2 is provided with a two-marine-blade mixer 6, used to homogenize the froth. The Moyno pump 3 draws the froth from the supply tank 2, passes it through the test pipeline 4, and either returns it to the supply tank 2 or to the pump inlet 7 thereby by-passing the supply tank 2. A variable speed (0–1100 rpm) motor 8 drives the Moyno pump 3. Since the Moyno pump 3 is a positive displacement pump, the flow rate or the speed of the froth in the pipeline 4 is easily determined from the pump's rpm and the pressure discharge in the pump. The pipeline 4 comprises a 1" (25 mm) diameter carbon steel pipe set in a horizontal "U" configuration.

The secondary loop 9 is where the water circulates and it comprises a small tank (provided with an electrical resistance) 10, a gear pump 11, a ¼" diameter pipeline 12 and a copper tube 13. The secondary loop 9 provides the main loop 1 with water for flushing, establishing a slug of fast moving water behind which the bitumen froth is injected. It also controls the temperature of the flowing froth. Water can be heated by electrical resistance and kept at a certain temperature in the small tank 10 before it is pumped through the copper tube 13 rolled inside the supply tank 2, around the Moyno pump 3 and around part of the pipeline 4.

Warm froth is loaded into the supply tank 2 and the mixer 6 is turned on. Meanwhile, warm water is circulated in the main loop 1 driven by the Moyno pump 3. This flushing and warming ensures that the pipeline 4 is clean and warm enough to receive the pre-heated and pre-homogenized froth. Once the froth is homogeneous, it is injected through the Moyno pump 3 to the main loop 1. Simultaneously, the water is diverted. When the froth entirely replaces the water, it is circulated by the Moyno pump 3 without further water addition. The shutdown procedure is the reverse of the start-up. The froth flow through the Moyno pump is stopped and water is injected to the line, completely diverting the remaining froth to the head tank, leaving only water circulating in the line.

Figure 2:
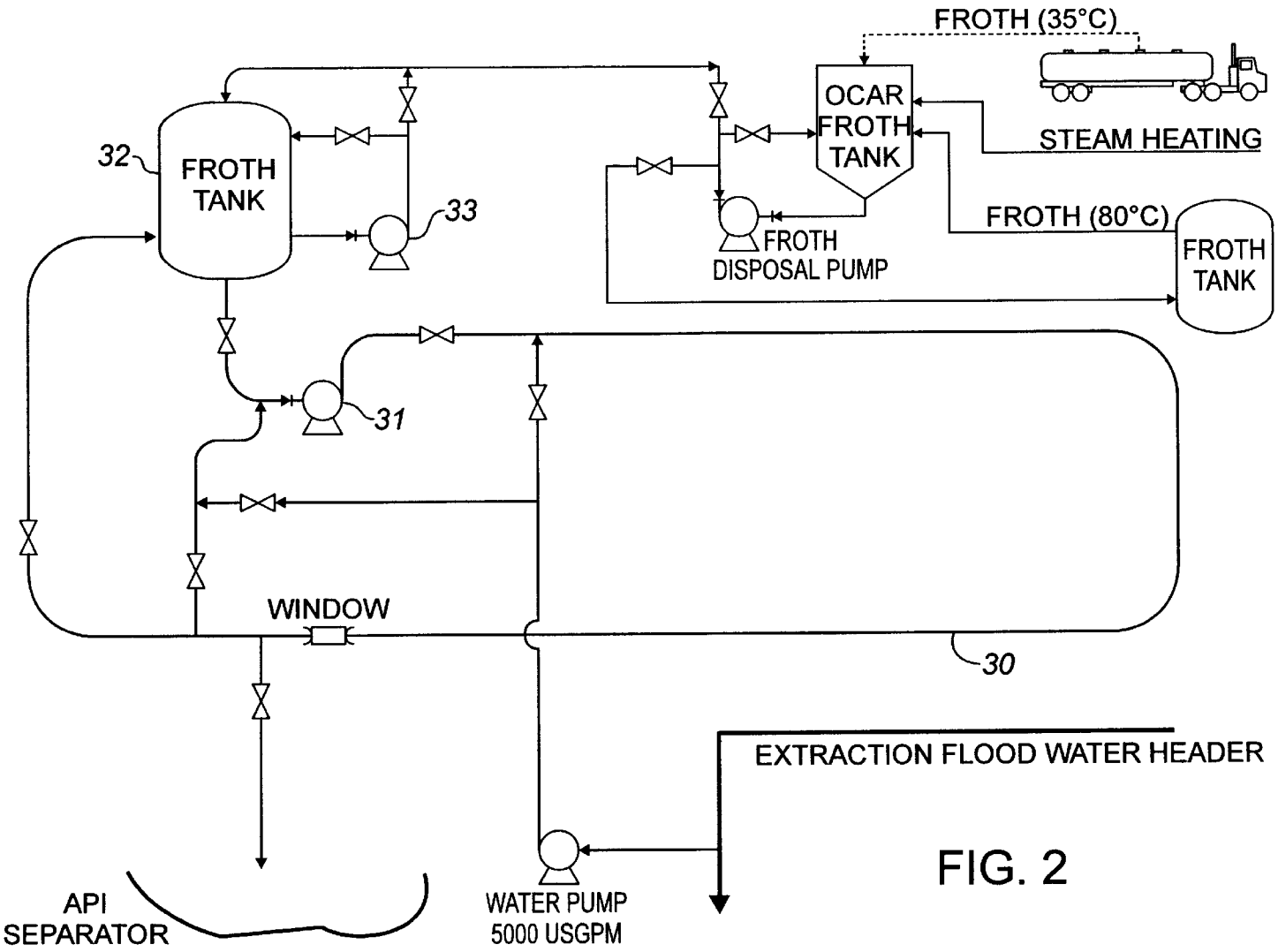
FIG. 2 is a schematic of the 24" diameter, 1000 m long pipeline test facility used to test self-lubrication conditions.

Pilot scale tests were also carried out in a closed loop system as shown in FIG. 2 whereby the loop consisted of a 24" (0.6 m) diameter and 1000 m long pipeline 35. The warm bitumen froth was mixed in the froth tank 32 by circulation through a mixing pump 33. The bitumen froth was then re-circulated in the pipeline loop 30, driven by a centrifugal pump 31. Flow rate and pressure drop were measured using an ultrasonic flowmeter and pressure transducers. The data was automatically collected and recorded. Before and after each test, the pipeline loop 30 was flushed with tap water. Pressure drop measurement as a function of flow rate was also carried out on froth water.

EXAMPLE 1

In this example, the 1" pipeline facility was used to establish self-lubricated core-annular flow of bitumen froth. The critical velocity required to achieve core-annular flow was difficult to measure precisely. It was easier to measure the smallest velocity for which self-lubricated core flow could be maintained; this value is obtained by monitoring the pressure drop as the flow rate is sequentially decreased. It is believed that this value is the same as or close to the critical value required to establish self-lubricated flow.

Figure 3:
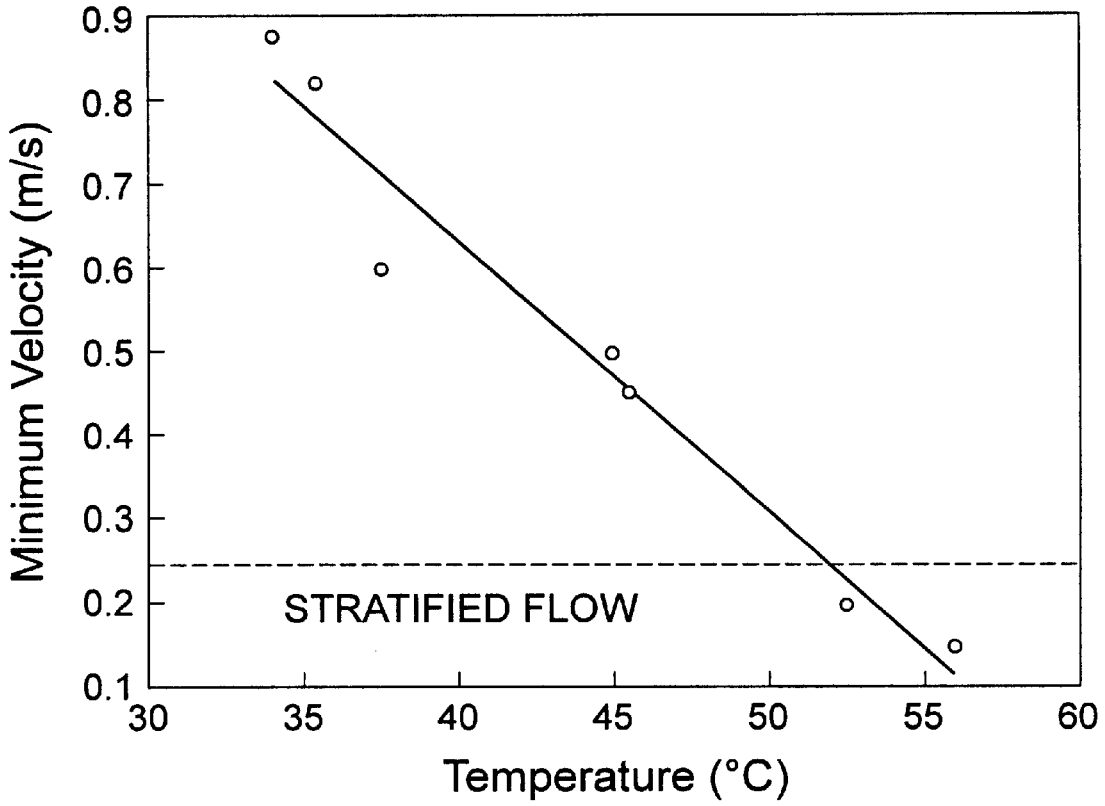
FIG. 3 is a plot of minimum velocity in m/sec for self-lubrication in a one-inch pipe as a function of temperature.

FIG. 3 shows that self-lubricated flow could be maintained at velocities exceeding 0.3 to 0.9 m/sec, depending on the temperature, with smaller critical values at high temperatures. In general, it can be said that there is a critical velocity, between 0.3 m/sec and 0.7 m/sec, for the start-up and maintenance of self-lubrication.

EXAMPLE 2

Pilot tests were done using the 24" (0.6 m) diameter, 1000 m long pipeline loop 30 to establish self-lubricated core-annular flow of bitumen froth. The centrifugal pump 31 drive speed was initially set at 650 rpm to obtain a froth flow velocity of about 1.0 m/sec. As the froth displaced the water in the pipeline 35, the pump discharge pressure increased. It took about 10 minutes to displace the water completely and to establish the core-annular flow. To ensure stable flow, the pump drive speed was gradually increased to 800 rpm. As the pump speed increased, the pump discharge head was well below that required for pumping water at similar flow rates. This operational setting was continued without change for 24 hours. During this period, the pressure and flow readings were monitored. There was no increase in the pressure drop, which indicates that bitumen fouling was not a problem. However, both froth temperature (47° C. vs. 43° C.) and velocity (1.10–1.14 m/s vs. 0.90 m/s) decreased for a fixed pressure drop across the loop as the night approached.

In another run, core-annular flow of bitumen froth at a temperature of about 55° C. was readily and predictably established in 10 minutes. The initial pump drive speed was set at 650 rpm and the froth flow velocity was maintained at about 0.9 m/sec for 2 hours of steady operation. The pump drive speed was raised from 650 rpm to 1000 rpm and then reduced gradually in steps of 50 rpm back down to 650 rpm. At each speed, pressure and flow readings were monitored for about 10 minutes. There was no hysteresis observed either in the velocity or pressure during the course of this run.

EXAMPLE 3

Figure 4:
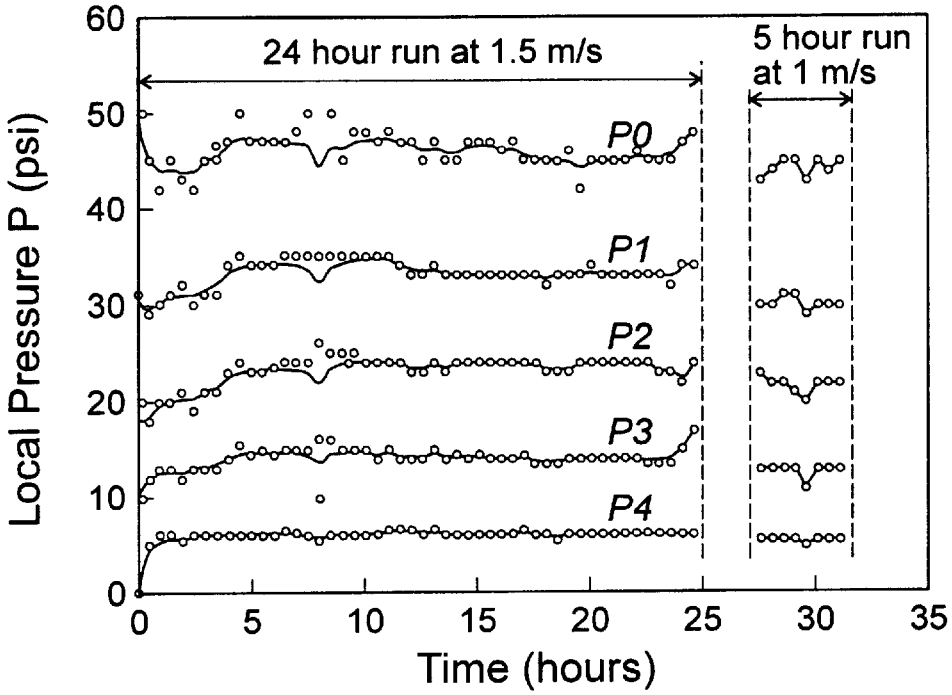
FIG. 4 is a plot of local pressure versus time for a 5 hour and a 24 hour run using the 1" pipeline test facility.

In the following experiments, the 1" pipeline facility was used to test for pressure build-up in the pipeline. The absence of any pressure build-up would indicate that fouling of the pipeline was not occurring to any significant degree. The first experiment involved pumping bitumen froth through the pipeline continuously for 24 hours. The water content of the bitumen froth was 27% by volume, the froth flow velocity was 1 m/sec and the temperature of the froth was 35° C. Samples were taken at various points throughout the pipeline and the local pressure measured. FIG. 4 shows that the pressure gradients did not increase as a function of time.

Figure 5:
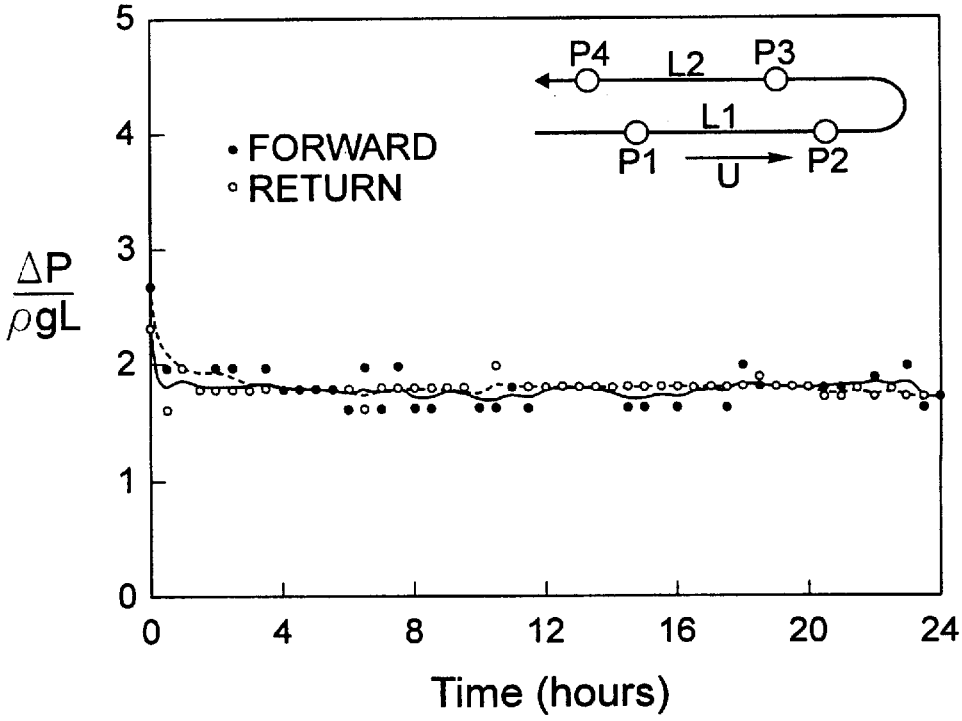
FIG. 5 is a plot of dimensionless pressure gradient versus time for a 24 hour run using the 1" pipeline test facility.

The second experiment involved pumping bitumen froth through the 1" pipeline continuously for 24 hours. In this case, the water content of the bitumen froth was 27% by volume, the froth flow velocity was 1.5 m/sec and the temperature of the froth was 37° C. FIG. 5 is a plot of the pressure gradient between two consecutive pressure taps in both the forward and return legs of the pipeline. FIG. 5 illustrates that the pressure gradients obtained during this test were constant thereby indicating that no significant degree of fouling occurred during this 24-hour interval. Any changes in the pressure gradient that were induced by the taking of samples from the pipeline were short lived.

Figure 6:
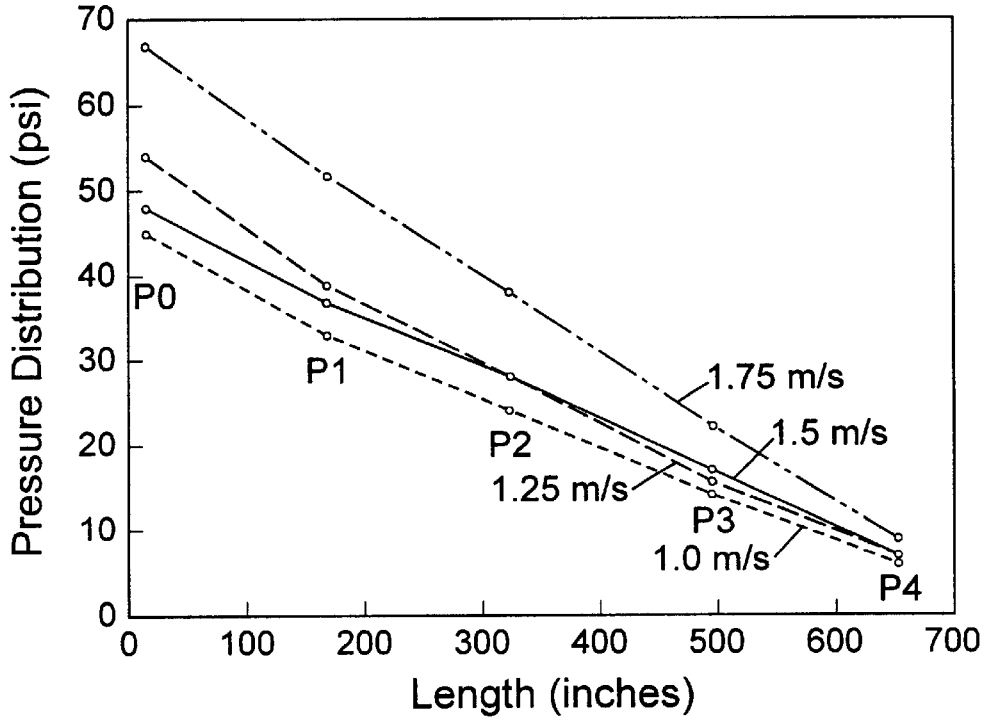
FIG. 6 is a plot of the pressure distribution along the length of the 1" pipeline.

The third experiment involved pumping bitumen froth through the 1" pipeline continuously for 96 hours. In this experiment the water content of the bitumen froth was 27% by volume, the froth flow velocity was varied between 1.0 m/sec to 1.75 m/sec, and the temperature was varied from 35° C. (for the velocity of 1.0 m/sec) to 42° C. (for the velocity of 1.75 m/sec). FIG. 6 shows the pressure distribution along the pipeline. The pressure increases are nearly linear in distance as in the pipe low of a single liquid. The mean values of the pressure wore calculated for each tap location along the pipeline for each velocity. The average temperatures of the froth increased because of the frictional heating to around 42° C. It is possible that some free water is re-absorbed into the froth at high temperatures as has been suggested by others, who found that heating and water-dilution affect the lubricating layer. Heated and unheated froth possessed a similar head loss, which hardly changes, when the total separable water content in the froth is increased to above 35%.

The water content of the froth used in the forth experiment is the highest ($\Phi$=40%) of all the samples tested. The dimensionless pressure gradient record for this watery sample shows more erratic behavior than less watery samples. However, the pressure levels are roughly those of other samples with different water contents. Moreover, in this experiment, as was the case for all the others, there was no evidence of a systematic increase of pressure that could indicate accumulation of fouling.

EXAMPLE 4

The concept of protection against pipe wall fouling was verified in the following test. Clay water from Syncrude's tailings pond was added to separate glass cylinders containing bitumen from two sources, namely, Syncrude bitumen and Zuata bitumen from Venezuela. Tap water was added to two other glass cylinders that also contained bitumen from the same two sources. The cylinders were allowed to rest for a period of time and then were inverted and the contents emptied. When clay water was used, the walls of the vessel never fouled, but the walls of the cylinder did foul when tap water was used. This phenomenon was observed when either Syncrude bitumen or Zuata bitumen was used.

EXAMPLE 5

In another experiment it was verified that the clay water promotes lubrication of froth from froth. Bitumen froth was sheared between two 3-inch (75 mm) diameter glass parallel plates. One plate was rotating and the other was stationary; water was released inside, fracturing the bitumen. The internal sheet of water was sandwiched between two layers of bitumen, which stuck strongly to the glass plates. The bitumen on the moving plate rotated with the plate as a solid body. The froth fractured internally as a cohesive fracture and not as an adhesive fracture at the glass plates. Some of the water in the sandwich centrifuged to edges.

EXAMPLE 6

Figure 7:
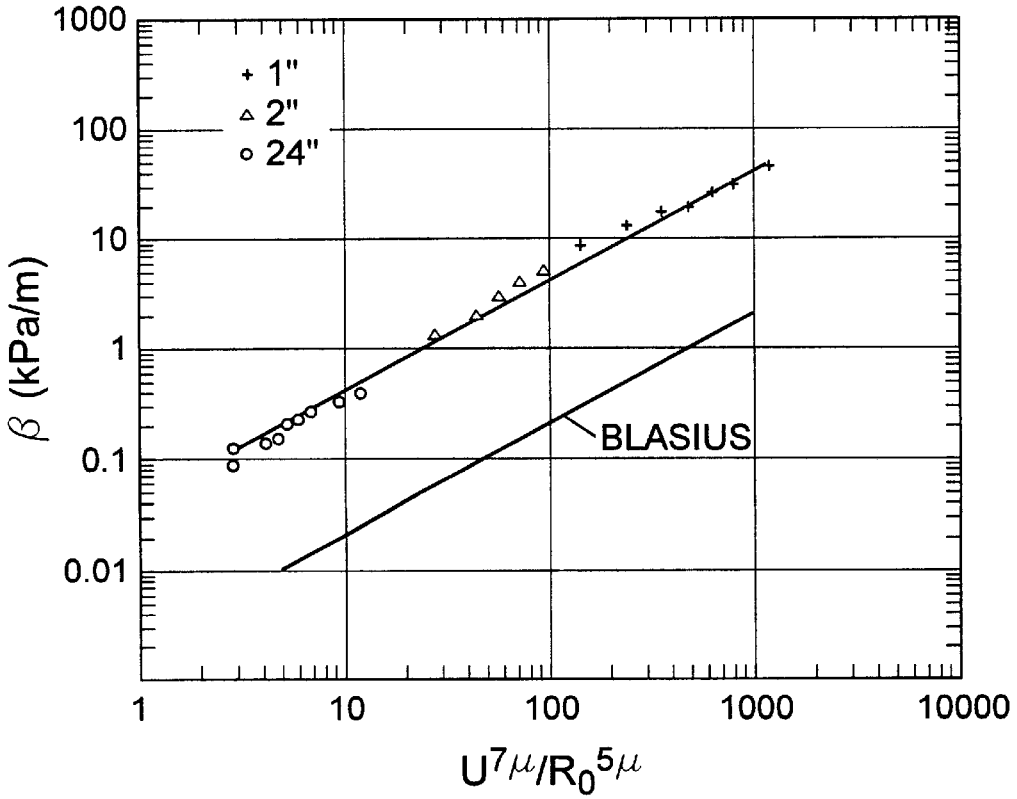
FIG. 7 is a plot of the pressure gradient of bitumen froth as a function of the ratio of the $7/4^{th}$ power of velocity to the $4/5^{th}$ power of the pipe radius when the froth temperature was above 50° C.
Figure 8A:
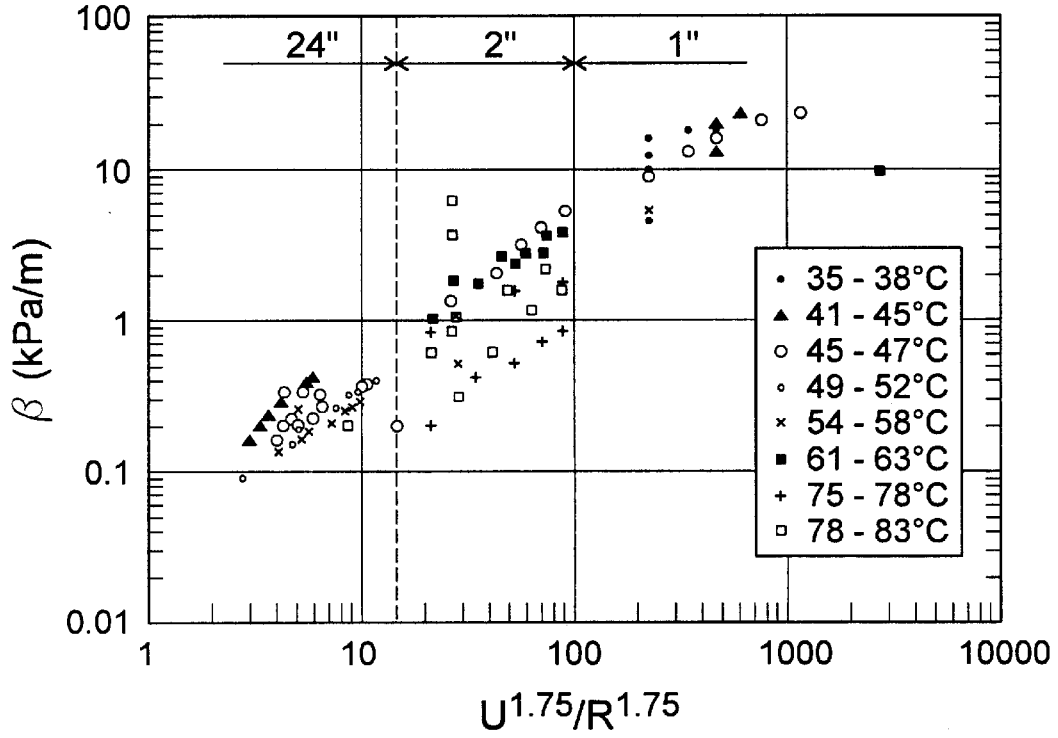
FIG. 8*a* is a plot of pressure gradient versus $U^{1.75}/R^{1.25}$ when the velocity is maintained at 1.0 m/sec.
Figure 8B:
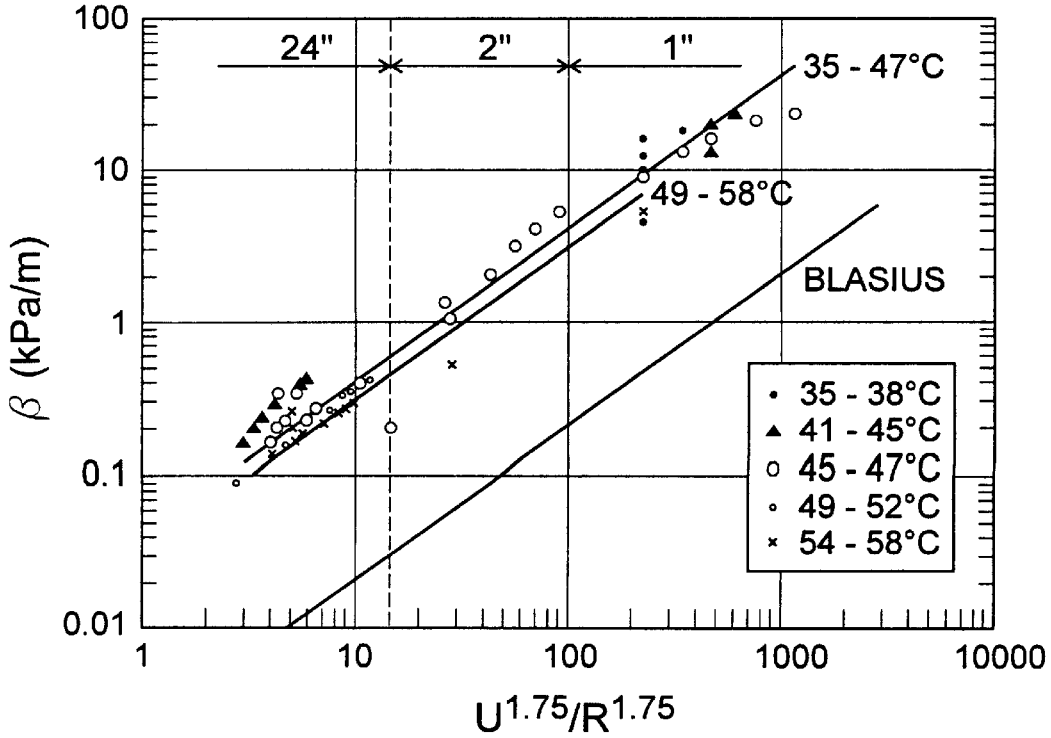
FIG. 8*b* is a plot of pressure gradient versus $U^{1.75}/R^{1.25}$ when the velocity is maintained at 1.0 m/sec and the temperature T ranges between 49 to 58° C. and 35 to 47° C.
Figure 9:
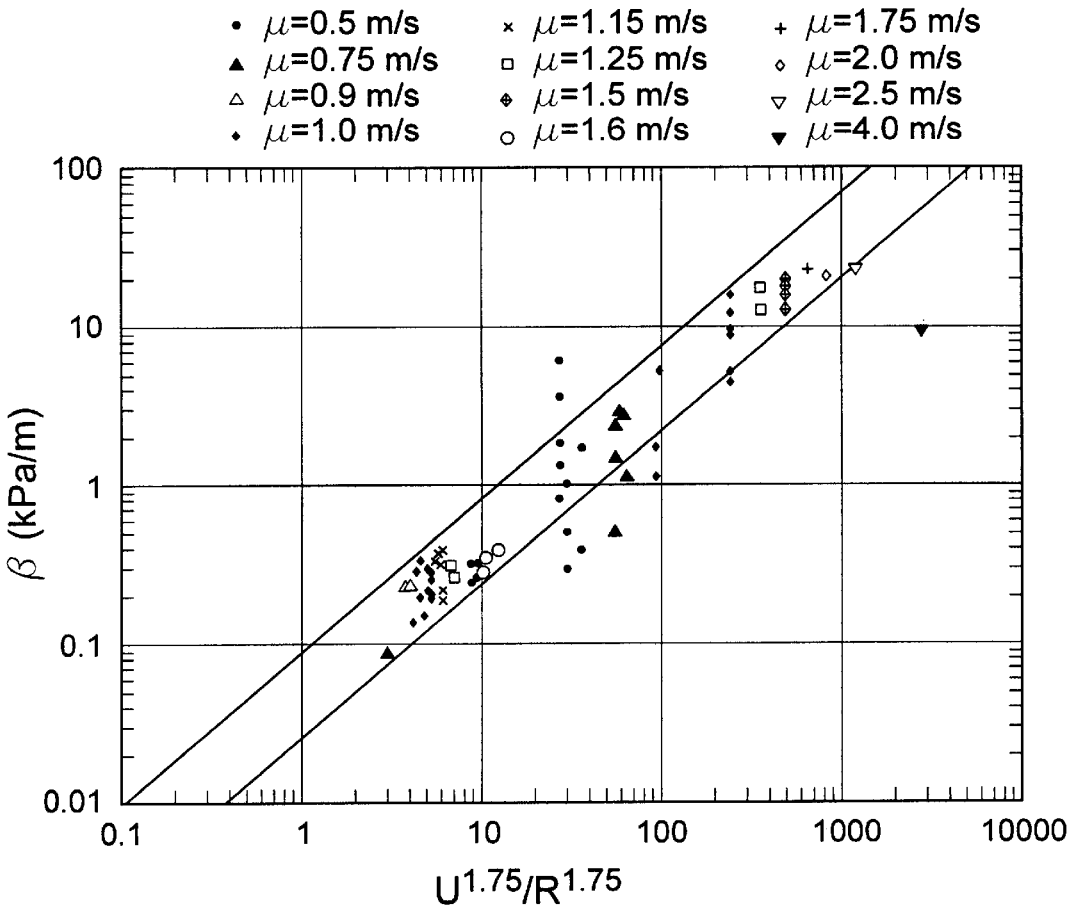
FIG. 9 is a plot of the pressure gradient of bitumen froth as a function of the ratio of the $7/4^{th}$ power of velocity to the $4/5^{th}$ power of the pipe radius, parameterized by velocity.

The data from several experiments where core-annular flow of bitumen froth was established in the 1", 2" and 24" pipelines, respectively, are summarized in FIGS. 7, 8 and 9. FIG. 7 is a plot of the velocity versus pressure drop when the froth temperature was above 50° C. As can be seen from this plot, all of the data fall onto a single line, parallel to the Blasius correlation for turbulent flow with high Reynolds numbers ($>3\times10^6$).

A scale-p equation for pressure gradient could be derived based on the data shown in FIG. 7 and the equation is shown as follows:

$$\beta=K\times U^{1.75}/R^{1.25} \quad \text{(Equation 1)}$$

where β(kPa/m) is the pressure gradient, U (m/sec) is the velocity arid R (m) is the radius of the pipe. The constant K is a function of temperature T and can be calculated as follows:

$$K=342.76e^{-0.061T} \quad \text{(Equation 2).}$$

FIG. 8*a* is a plot of pressure gradient versus $U^{1.75}/R^{1.25}$ when the velocity is maintained at 1.0 m/sec. FIG. 8*a* illustrates that there is a strong correlation between pressure drop, pipe diameter and fluid velocity. FIG. 8*b* shows the same plot as FIG. 8*a*, except that the results have been isolated for two distinct temperature ranges, namely, 49 to 58° C. and 35 to 47° C.

It can be seen in FIG. 8*b* that the data yielded two parallel lines for the two temperature ranges. The constants K as per Equation 2 are 28 and 40.5, respectively, for the higher and lower temperatures, indicating the potential for about a 60% increase in the pressure drop as the average froth temperature decreased from 55° C. to 45° C. The two parallel lines in FIG. 8*b* are also parallel to the Blasius correlation line and hence the corresponding pressure drop ratios are roughly between 10 and 20.

The emergence of the two distinct parallel lines in FIG. 8*b* strongly suggests that pressure drop is temperature dependant. When the froth temperature is between 35 and 47° C., the pressure gradient that can be maintained by the addition of colloidal clay to the water dispersed in the bitumen froth is 10 to 20 times that for pumping water alone. When the temperature is between 35 and 47° C., the pressure gradient required for froth pumping is up to 40 times that of pumping water. These data translate into a pressure gradient in the order of 1000 times smaller than the pressure gradient that would be necessary if the flow was not lubricated and the pipe wall was fouled with bitumen.

FIG. 9 is a plot of pressure drop versus the $U^{1.75}/R^{1.25}$ factor as discriminated by velocity. The reduction of the pressure gradient appears to undergo a dramatic decrease at a critical value of the velocity, which is believed to be about 1.6 m/sec. Above 1.6 m/sec flow appears to be in super-lubricated mode and as such, mass flow of bitumen froth can be increased for only marginal changes in the pressure gradient. The upper velocity limit for maintaining successful lubrication has not been established. For example, bitumen froth was run in a self-lubrication mode in the 1" diameter line pipe loop set up at about 4 m/sec which was the limit of speed obtainable with the. experimental set up.

In summary, the results given in FIGS. 7, 8 and 9 show that the pressure gradient is proportional to the ratio of the $7/4^{th}$ power of velocity to the $4/5^{th}$ power of the pipe radius. The constant of proportionality in froth is 10 to 40 times larger than in the turbulent flow of water alone (shown as the Blasius line). Further, the results show that the lubricating is in turbulent flow and the constant of proportionality is a decreasing function of temperature and velocity.

The embodiments of the invention in which an exclusive property or privilege is claimed are defined as follows:

1. A method for transporting deaerated bitumen froth containing 20 to 40% by volume froth water, said froth water containing colloidal-size particles, through a pipeline, thereby establishing self-lubricated core-annular flow of the deaerated bitumen froth, comprising:

injecting water into the pipeline to make the interior walls of the pipeline water-wet; and injecting deaerated bitumen froth into the pipeline behind the water at a velocity greater than 0.3 m/sec.

2. The method as set forth in claim 1 wherein the deaerated bitumen froth is heated to a temperature greater than 35° C. prior to being injected into the pipeline.

3. The method as set forth in claim 2, wherein the water being injected into the pipeline contains colloidal-size particles.

4. The method as set forth in claims 1 wherein the water being injected into the pipeline contains colloidal-size particles.

5. A method for transporting deaerated bitumen froth containing 20 to 40% by volume froth water, said froth water containing colloidal-size particles, through a pipeline, thereby establishing self-lubricated core-annular flow of the deaerated bitumen froth, comprising:

injecting deaerated bitumen froth into a water-wet pipeline behind air at a velocity greater than 0.3 m/sec.

6. The method as set forth in claim 5 wherein the deaerated bitumen froth is heated to a temperature greater than 35° C. prior to being injected into the pipeline.

7. The method as set forth in claim 6, wherein the water used to make the pipeline water-wet contains colloidal-size particles.

8. The method as set forth in claims 5 wherein the water used to make the pipeline water-wet contains colloidal-size particles.

9. A method for re-starting self-lubricated core-annular flow of deaerated bitumen froth through a pipeline after pumping of the deaerated bitumen froth has been temporarily shutdown, comprising:

connecting a water source and a means for pumping the water to the pipeline at a plurality of points along its length, thereby dividing the pipeline into a series of sequential segments;

sequentially injecting water at each point along the length of the pipeline at a velocity greater than 0.3 m/sec at low pumping pressure, thereby replacing the segment of froth with water; and injecting deaerated bitumen froth into the pipeline behind the water at a velocity greater than 0.3 m/sec.

10. A method for reducing deposits of heavy oil on the interior walls of a pipeline during core-annular flow comprising simultaneously injecting heavy oil and water into a pipeline to initiate core-annular flow wherein said water contains hydrophilic solids of colloidal size at a concentration above that necessary for saturation of the oil-water interface.

11. A method for transporting deaerated bitumen froth containing 20 to 40% by volume froth water, said froth water containing colloidal-size particles, through a pipeline of a known radius (R), thereby establishing self-lubricated core-annular flow of the deaerated bitumen froth, comprising:

injecting water into the pipeline to make the interior walls of the pipeline water-wet; and injecting deaerated bitumen froth into the pipeline behind the water at a temperature (T) and velocity (U) which satisfies the equation $\beta = K \times U^{1.75}/R^{1.25}$, where $\beta$ is the pressure gradient and K is a constant and a function of temperature T.

12. The method as set forth in claim 11 wherein the water being injected into the pipeline contains colloidal-size particles.

* * * * *